US009656365B1

(12) United States Patent
Halstead

(10) Patent No.: US 9,656,365 B1
(45) Date of Patent: May 23, 2017

(54) HONING TOOL AND METHOD

(71) Applicant: Empire Magnetics Inc., Rohnert Park, CA (US)

(72) Inventor: Richard Halstead, Rohnert Park, CA (US)

(73) Assignee: EMPIRE MAGNETICS INC., Rohnert Park, CA (US)

( * ) Notice: Subject to any disclaimer, the term of this patent is extended or adjusted under 35 U.S.C. 154(b) by 277 days.

(21) Appl. No.: 14/340,967

(22) Filed: Jul. 25, 2014

Related U.S. Application Data

(60) Provisional application No. 61/859,414, filed on Jul. 29, 2013.

(51) Int. Cl.
*B24B 33/02* (2006.01)
*B24B 33/08* (2006.01)

(52) U.S. Cl.
CPC ..... *B24B 33/02* (2013.01); *B24B 33/087* (2013.01)

(58) Field of Classification Search
CPC ..... B24B 33/02; B24B 33/087; B24B 33/022; B24B 33/025
See application file for complete search history.

(56) References Cited

U.S. PATENT DOCUMENTS 5,125,299 A * 6/1992 Strait ..... B23C 3/051 408/83.5
2008/0233851 A1* 9/2008 Kubo ..... B24B 41/044 451/541

* cited by examiner

*Primary Examiner* — Joseph J Hail
*Assistant Examiner* — Joel Crandall
(74) *Attorney, Agent, or Firm* — Edward S. Sherman

(57) ABSTRACT

The axial rotation of a honing tool head and the radial advance of the co-rotating honing stones are accomplished simultaneously by a magnetic coupling. The magnetic coupling connects an inner and drive axle that are driven independently. When the inner axial is driven at a differential speed than the drive axle, a connected pinion gear mechanism is engaged to transfer torque and radially displace the honing stones in response to the speed difference.

21 Claims, 7 Drawing Sheets

HONING TOOL AND METHOD

CROSS REFERENCE TO RELATED APPLICATIONS

The present application claims the benefit of priority to the US Provisional Patent Application of the same title having application Ser. No. 61/859,414 which was filed on Jul. 29, 2013, and is incorporated herein by reference.

BACKGROUND OF INVENTION

The present invention relates to an improved honing tool and method, and more particularly to a means for moving the honing stoning radially during the honing process.

Prior methods of honing require the oscillation and rotation of the honing head to advance in a stepwise fashion as the honing stones are advanced or retracted. This reduced machine throughput potential, and limits process control means.

It would be an advance in the art to have a simple convenient way to move the honing stone positions continuously while material is removed in the honing process and appropriate control means during such a process to avoid excess material removal.

SUMMARY OF INVENTION

In the present invention, the first object is achieved by providing a rotary machining tool comprising a rotating magnetic coupling having a first cylindrical bore, a drive axle having a first primary cylindrical axis and work tool end and a driving end opposite the work tool end, wherein the drive axle is supported by one or more rotary couplings in the rotating magnetic coupling, an inner axle having a second primary cylindrical axis disposed concentrically within at least a portion of the drive axle, wherein the inner axle is supported by one or more rotary couplings in the drive axle, in which the first and second primary cylindrical axis are co-incident with a geometric center of the cylindrical bore, a magnet coupling means having a portion attached to the outer periphery of the inner axial that is operative co-rotate the inner axle with the external rotation of the magnetic coupling, a tool head coupled to the working tool end of said drive axle, said tool head having a third primary cylindrical axis and comprising, a plurality of abrasive member tangential spaced apart about the third cylindrical axis, each abrasive member coupled to a radial positioning means for radial position adjustment from at least partially within the tool head to beyond an outer periphery of the tool head, at least one drive means for coupling torque from the inner axle to the radial positioning means.

A second aspect of the invention is characterized by each of the honing stones is set in a gear driven support member which is geared to advance or retract in the radial direction with respect to the third cylindrical axis, and the radial positioning means is a pinion gear drive coupled to the inner axial that urges the simultaneous drive of the geared support members when the inner and out axle rotate at different speeds.

Another aspect of the invention is characterized by the rotary machining tool having a magnet coupling means further comprises a first plurality of magnets disposed about the inner periphery of the first cylindrical bore, wherein the magnets in said plurality are arranged with opposing polarity to each adjacent magnets and the portion of the magnet coupling means attached to the outer periphery of the inner axial is a second plurality of magnets, wherein the magnetic in the second plurality are arranged with opposing polarity to each adjacent magnet in the second plurality.

The above and other objects, effects, features, and advantages of the present invention will become more apparent from the following description of the embodiments thereof taken in conjunction with the accompanying drawings.

DETAILED DESCRIPTION

Figure 1:
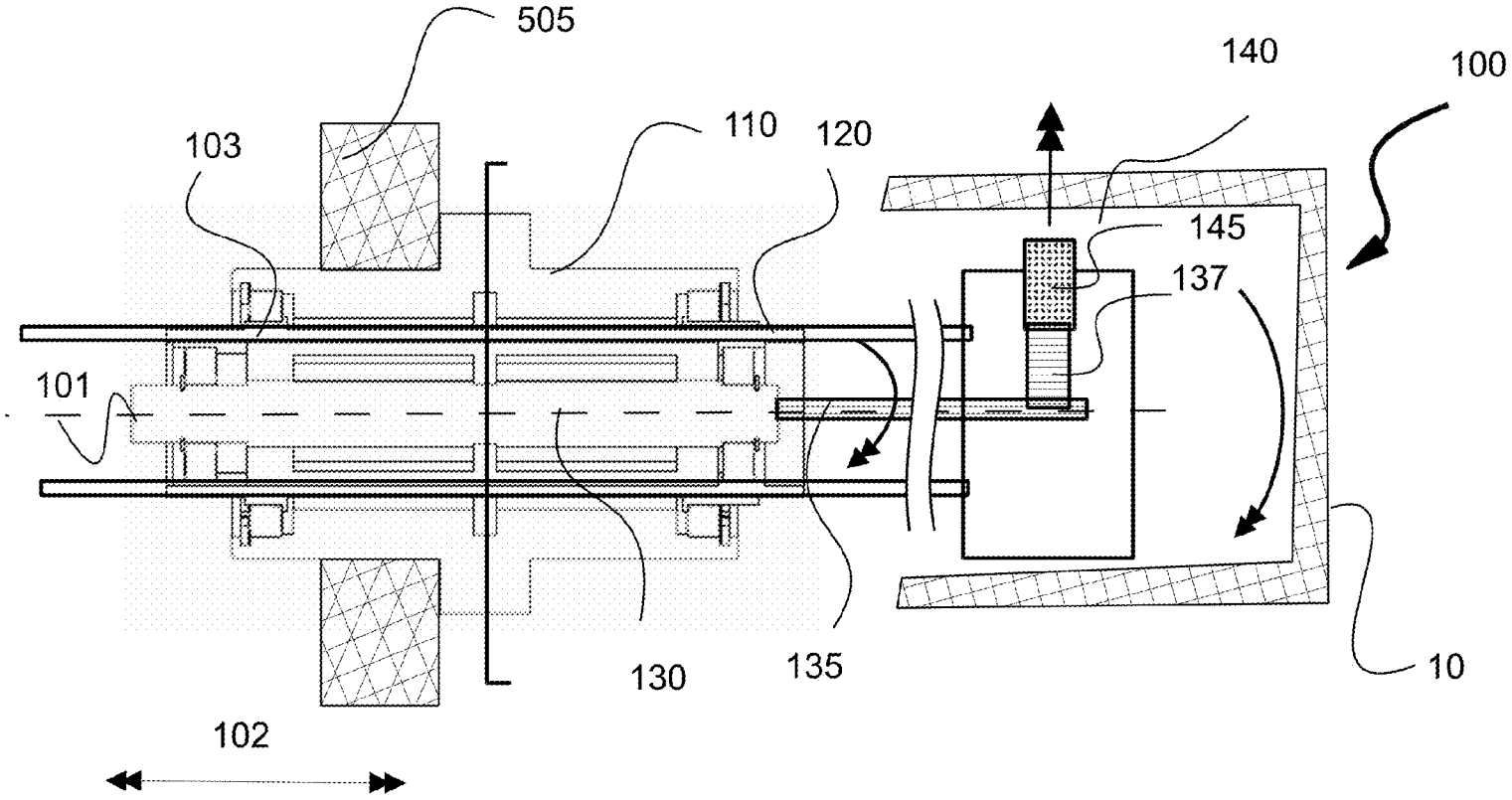
FIG. 1 is schematic longitudinal cross-section elevation view of a honing tool deploying a magnetic coupling in boring a work piece.
Figure 2:
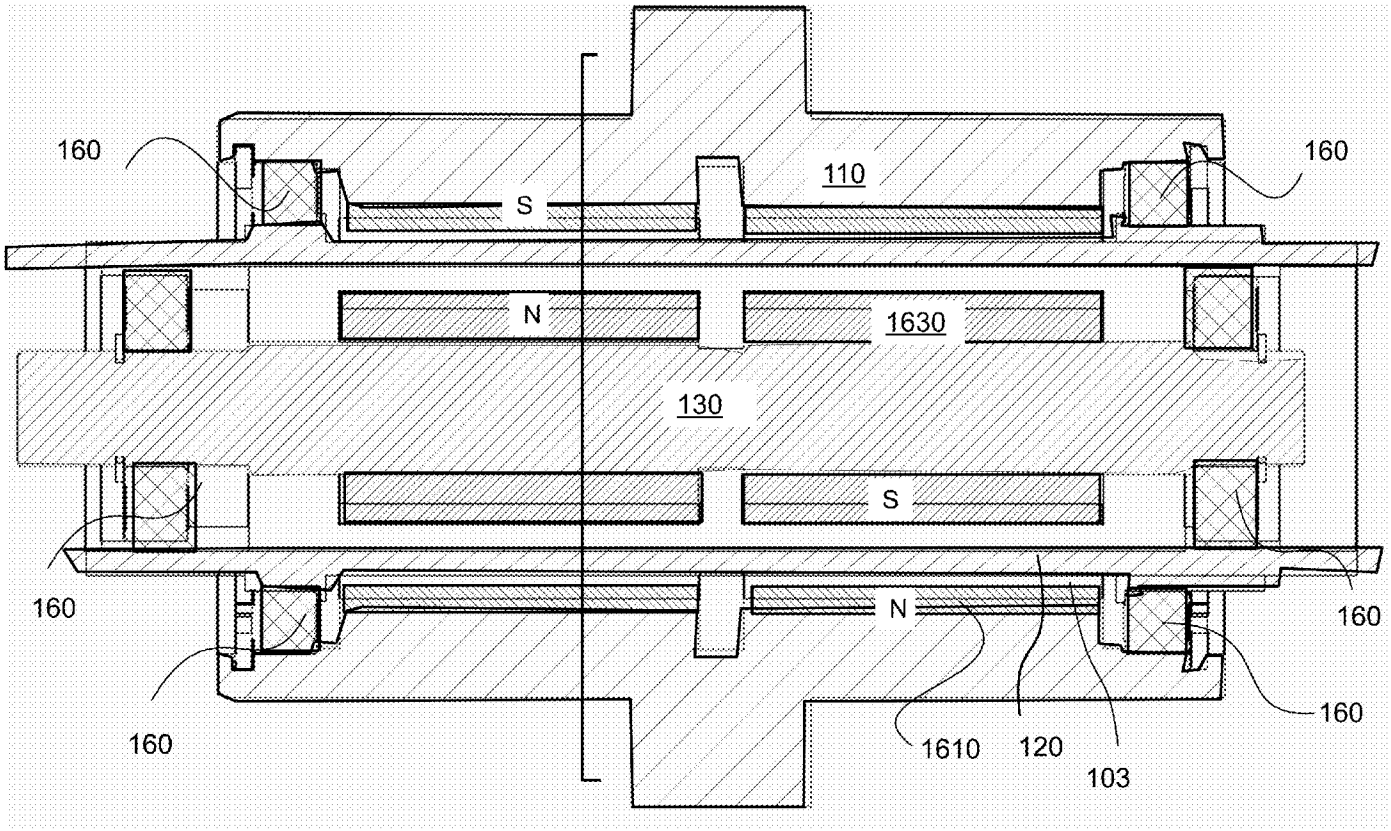
FIG. 2 is a detailed longitudinal cross-section elevation view of the magnetic coupling shown in FIG. 1.

Referring to FIGS. 1 through 7, wherein like reference numerals refer to like components in the various views, there is illustrated therein a new and improved Honing Tool and Method, generally denominated 100 herein.

In accordance with the present invention, a honing tool 100 has a rotary magnetic coupling 110, which contains a rotating drive axle 120, as well as a concentrically disposed inner axle 130. The rotating drive axle 120 is connected to the tool head 140. Pluralities of spaced apart abrasive or sharpened cutting members 145 are disposed about the circumferential direction of the tool head 140. The abrasive/cutting members 145 are commonly referred to as honing stones, and can be adjusted in the radial displacement from the central cylindrical axis 101.

Typical mechanism for adjustment of the abrasive members 145 in a honing tool are disclosed in U.S. Pat. Nos. 2,439,117; 3,216,155 and 4,524,549, which are incorporated herein by reference. One or more honing stones 145 can be set in tangentially spaced apart in mounts that are driven by a linear gear 137 that engages the pinion gear 135. The direction of rotation of the inner axle 130 thus directs the direction of travel of the linear gears 137 to drives the honing stones 145 inward away from the work piece 10, our outward toward the work piece 10, which can then continues to expand the bore hole concentrically. The rotating drive axial oscillates in the axial direction (arrow 102) as it rotates to complete the honing process. In the former case, retracting the honing stones 145 permits the removal of the tool head 140 from the completed bore hole formed in a work piece 10. These various drive mechanisms deploy some sort of pinion gear 135 that rotates with the inner axle 130 when the drive axle 120 is stationary. In conventional technology, the inner axle is activated via a clutch and slip rings, which requires stopping the drive axle 120 rotation.

The magnetic coupling 110 provides the desirable benefit of driving the honing stones 145 radially without having to stop or slow the rotation of the drive axle 120. With appropriate process control as described further below, a boring or honing process can be continuous until a predetermined dimension is reached and/or the effective pressure exerted by the cutting or abrading tool (or feed rate) can be adjusted to optimize the removal of material.

In one embodiment, the magnetic coupling 110 comprises at least one first set of spaced apart magnets 1610 connected to the inner periphery of the magnetic coupling 110. The magnets 1610 have their opposing north and south poles pointing radially, while immediately adjacent magnets alternate in polarity.

Likewise there is at least one second set of spaced apart magnets 1630 connected to the outer periphery of the inner axle 130. The magnets have their opposing north and south poles pointing radially, while immediately adjacent magnets alternate in polarity.

The inner magnets 1630 connected to the inner axle 130 are separated from the outer magnets 1610 connected to the inner circumference of the magnetic coupling 110 by a gap 103. The annular drive axle 120 passes through gap 103 and surrounds the inner axle 130 and attached magnets 1630. As at least this portion of the drive axle 120 within the magnetic field of the magnetic coupling is non-magnetic, the magnets stay aligned so that the magnetic coupling 110 and inner axle 130 stay aligned and are co-rotated independently of the drive axle. Magnetic coupling 110 can deploy opposing magnets arrays 1610 and 1630 or magnets 1630 and an AC induction coil replacing magnets 1610.

Figure 3:
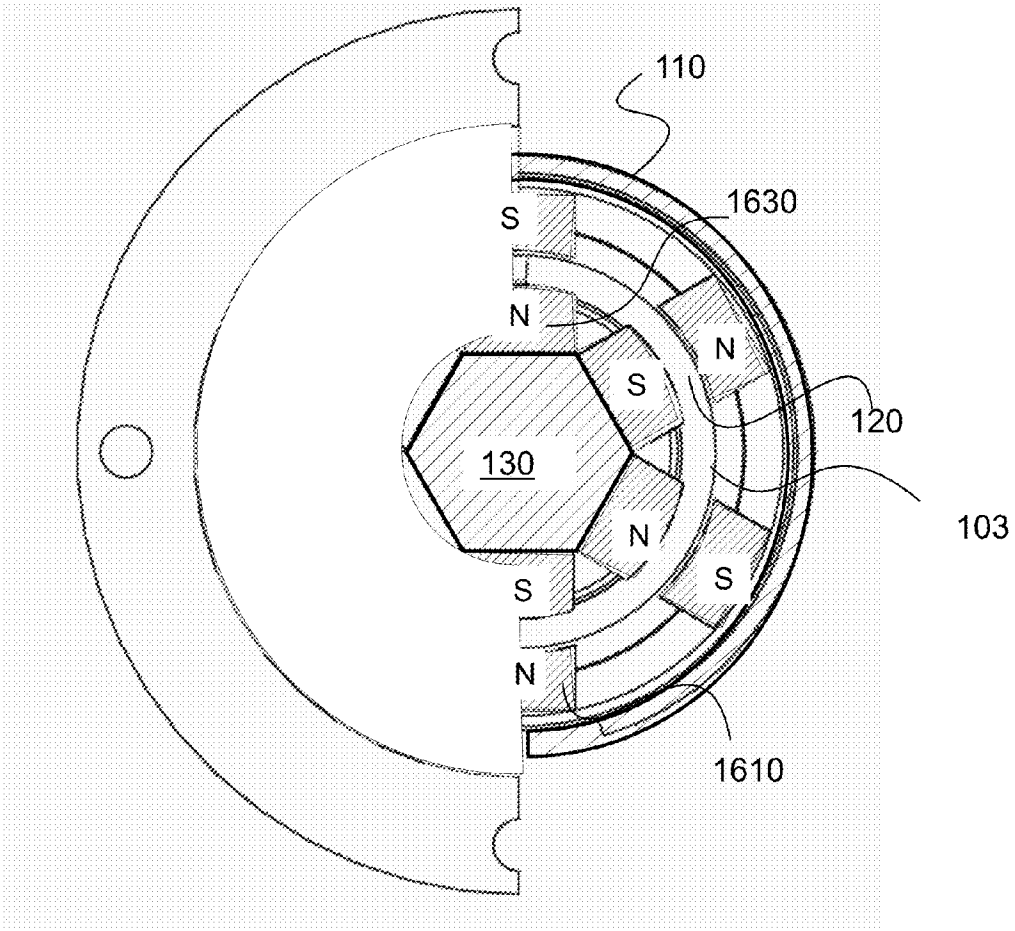
FIG. 3 is a split axial cross-sectional elevation through the magnetic coupling at the section line A-A in FIG. 1.
Figure 4:
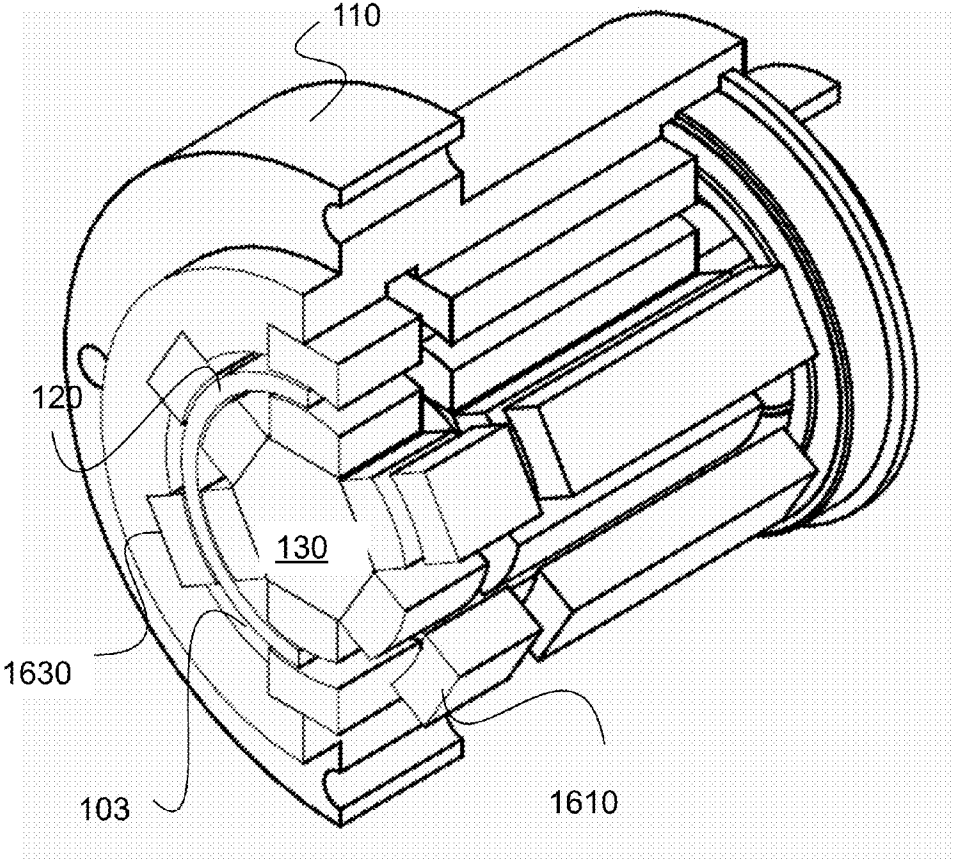
FIG. 4 is a cur-away perspective view of the magnetic coupling.

In a more preferred embodiment, the inner axle 130 has a polygonal cross-section to provide flat faxes for attaching a plurality of high strength magnets of opposing polarity, as indicated by the N and S poles in FIG. 3, with one magnet disposed on each face. In contrast, the magnets 1610 are preferably inset in cavities in the inner periphery of the bore of the magnetic coupling 110. It is additionally preferable that the facing magnetic surface of magnets 1610 and 1630 are machined to having concave and convex surface respectively so that the annular gap 103 that contains drive axle 120 is substantially cylindrical in inner and outer circumference. Thus, the attraction between opposing pairs of oppositely oriented magnets stay aligned so that the magnetic coupling 110 and the inner axial rotate at the same speed.

It should be appreciated that as illustrated generally in FIG. 1, the magnetic coupler 110 and the drive motor 510 or 505 can be integrated into a common unit having a hollow central shaft that accepts the hollow drive shaft 120 and the internal central shaft 110 that drives the pinion gear that advances and retracts the honing stones.

A plurality of rotary bearings 160 separate the rotating magnetic coupling 110, inner drive axial 120 and inner axle 130 that is connected to the pinion gear 135. The rotary bearings 160 are provided as pairs disposed at opposing sides of the magnetic coupling 110 distal and proximal to the honing head 140.

Figure 5:
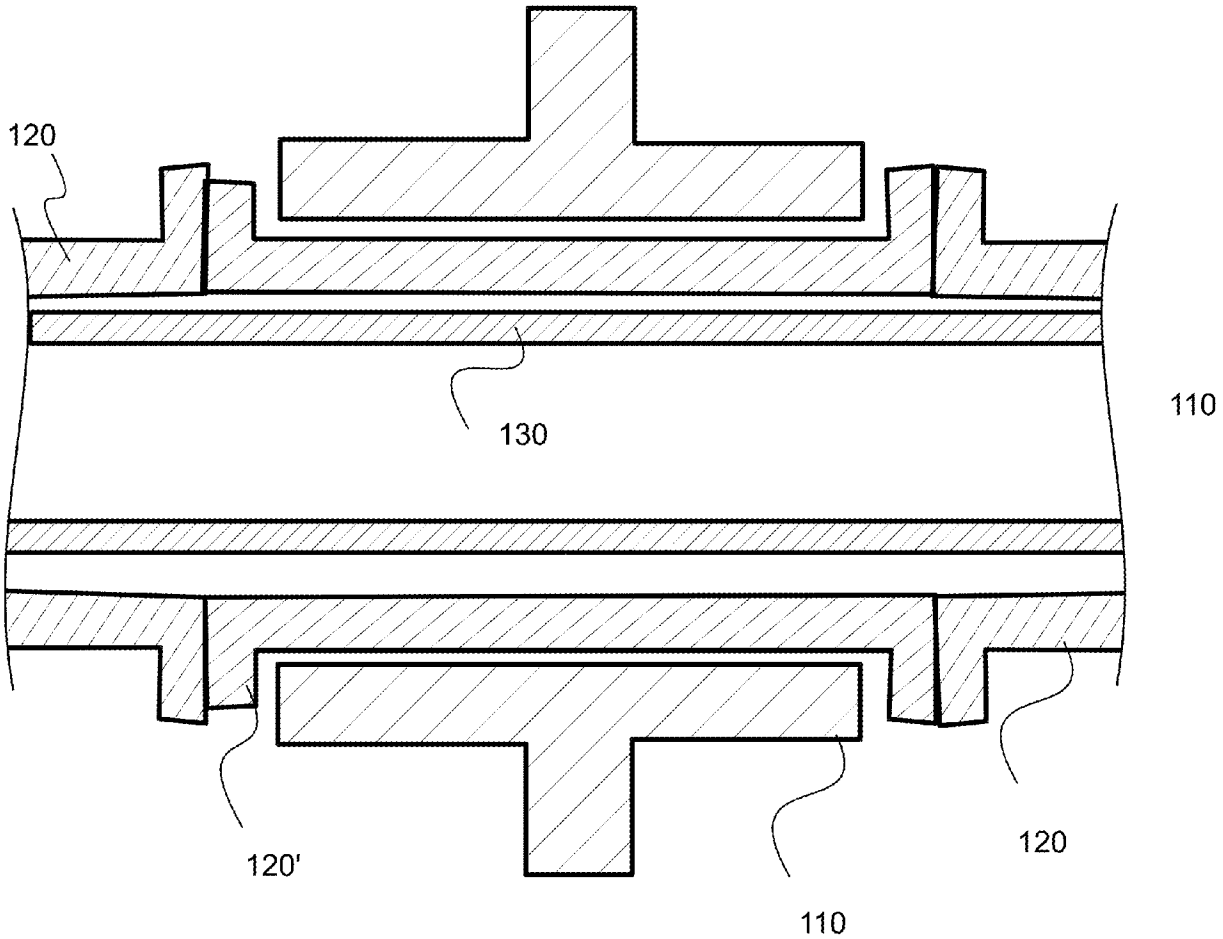
FIG. 5 is a perspective view of an alternative drive motor for the magnetic coupling showing the drive motors used to rotate the honing tool via the drive shaft and axially oscillate the honing head.

As illustrated in FIG. 5, the drive axle 120 is attached to motor 520. Another motor 540 drives the axial oscillation of the platform 525 supporting motor 510 in the direction of arrows 102, whereas motor 530 optionally rotates the magnetic coupling 110 via a planetary gear 535.

Figure 6:
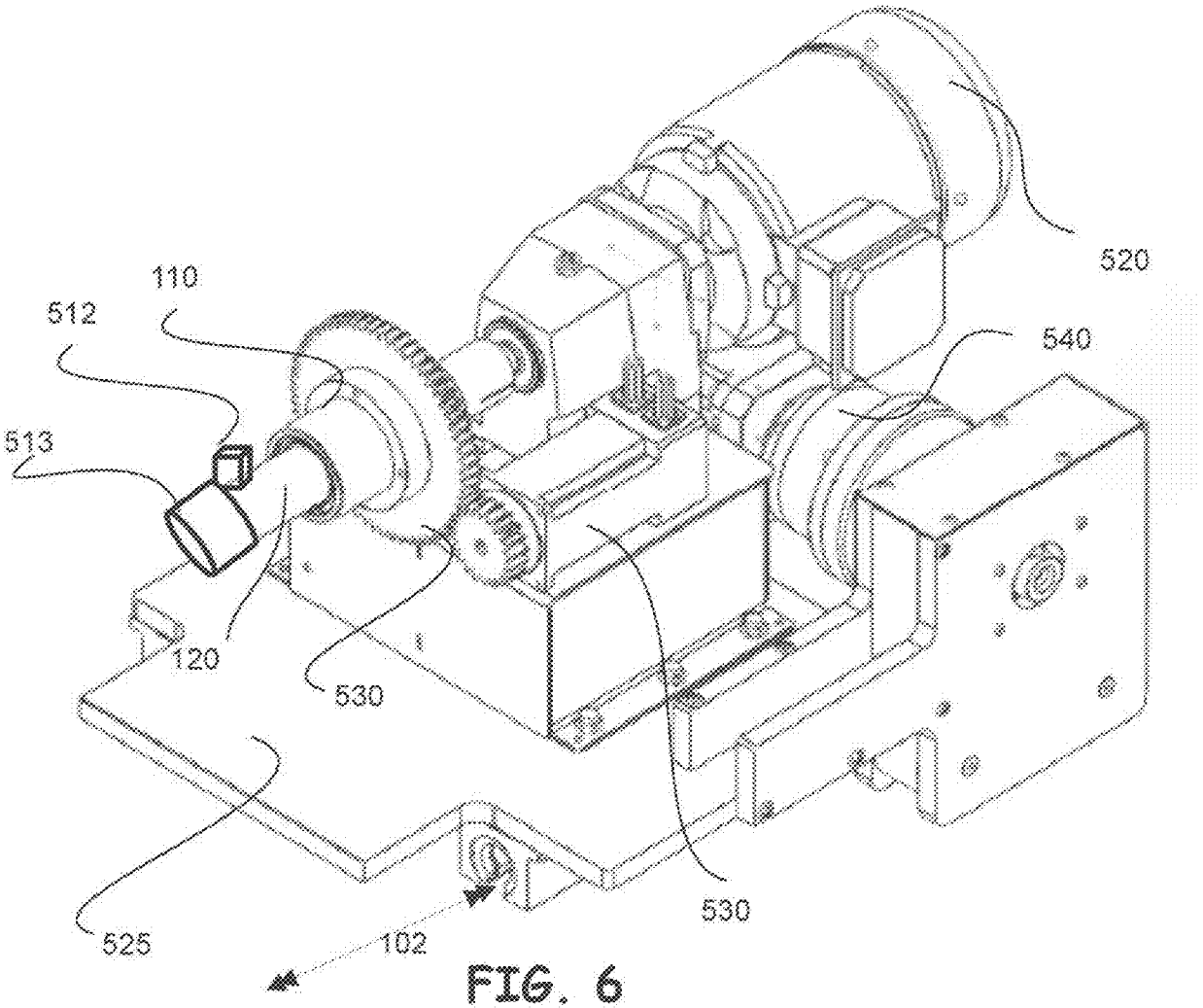
FIG. 6 is a schematic cross-sectional elevation of an alternative embodiment of the magnetic coupling.

It is also preferred that either the drive shaft 120 or a portion thereof within the magnetic field of coupling 110, (drive shaft portion 120' as illustrated in FIG. 6), is both non-magnetic and non-conductive. It is more preferred that this portion 120' is a fiberglass epoxy composite tube, and the like. If the drive tube 120 is made of non-magnetic material, such as 300 series stainless steel there will be some circulating currents, causing more power consumption in motor 510, and possibly heating which would become greater during rapid extension and retraction of the honing stones. In such conditions, as additional embodiment of the invention is providing cooling fines to drive axle 120.

The inner axial 130 is connected to the pinion gear 145 that drives the abrasive members 145. When the inner and outer axial are driven to rotate at the same speed the pinion gear will not engage the gear mechanism that drives the honing/abrasive stones radially. However, when there is a difference in drive speed, the magnetic coupling 110 prevents slippage of the inner axial 130 by magnetic attraction, the differential speed will be converted into a torque that turns the pinion gear 135 urge the linear gear mechanism 137 coupled to the honing stones 145 forward or backward, depending on the which axle is being driven at a slower speed.

Hence, another aspect of the invention is at least one drive means for rotating the outer magnetic coupling 110 that transfers torque from the inner axle 130 to the radial positioning means for the honing stones 145.

Drive means, such as for motor 510 to the magnetic coupling 110 can be direct, or via gears or an offset drive belt, as for example via an axial gap motor 505 in which the magnetic coupling 110 is essentially the hollow core central shaft to accommodate the drive shaft 120.

One or more sensors 512 are optionally in communication with drive axle 120, such as a rotary encoders or a means detect the motor current draw of motor 520 to determine the position and/or point of contact of the honing stones. Alternatively, in-line or equivalent torque sensor 513 can be deployed on a portion of axle 120, such as a torque strain gauge to measure the load on the honing stones.

Figure 7:
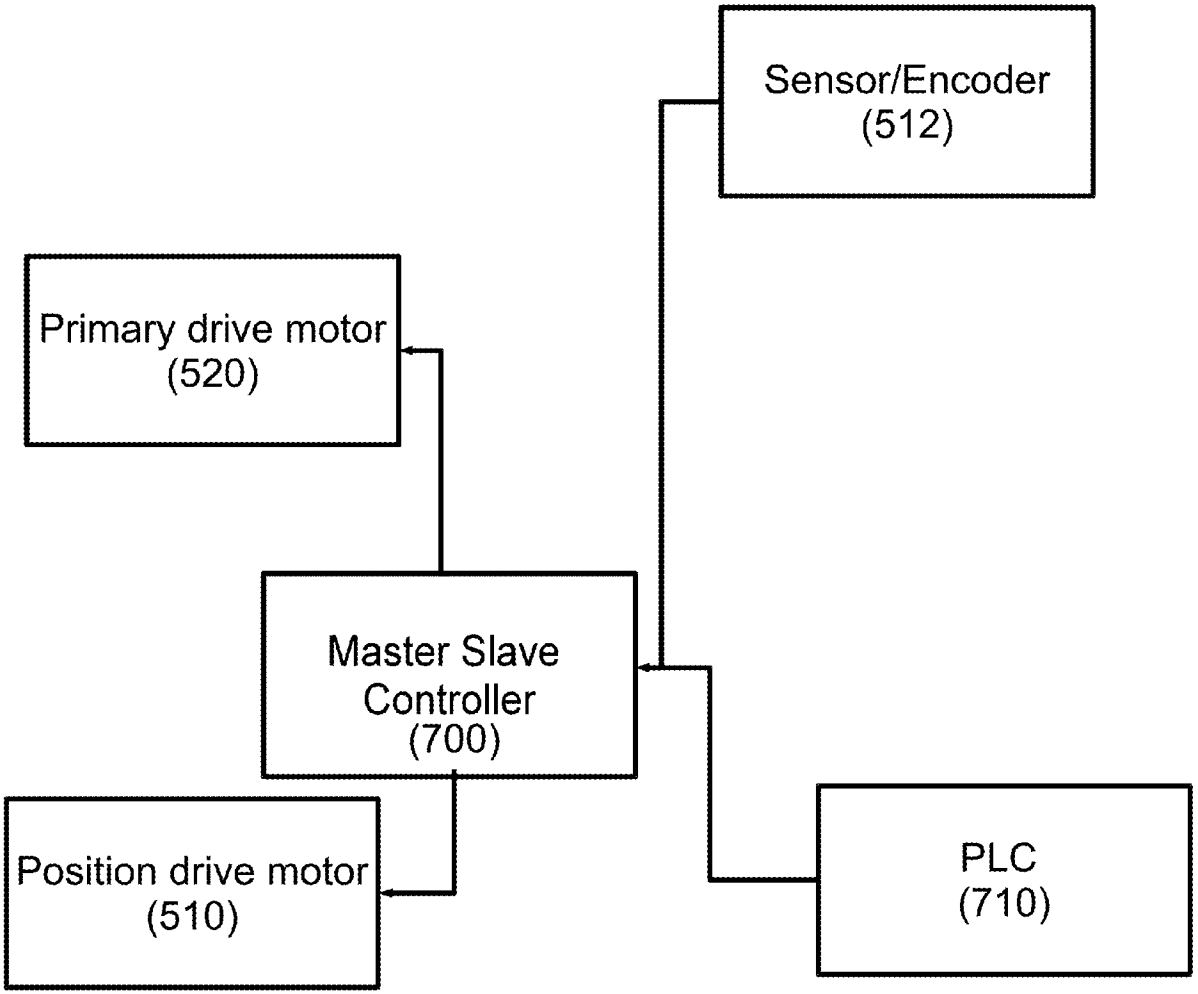
FIG. 7 is a schematic diagram of a control scheme for the drive motors in FIGS. 1 and 5.

In a more preferred embodiment, Illustrated in FIG. 7, the primary drive motor 520 and position drive motor 510 is in communication with a master-slave control module 700 that deploys the sensor or rotary encode to measure the master (primary drive motor speed) and in a slaved arrangement, adjust to position drive motor speed according to a predetermined schedule or procedure (provided by a microprocessor in the control module or a separate Programmable Logic Controller (PLC) 710 based on the final part dimensions, wear rate of the material being removed by the honing stones, and desired surface finish.

The above controls can be used in at least 2 modes of operation. First, based on first establishing a zero reference for the hone stone or cutting tool position, the controller can track the position of the hones with the software in the PLC 710 or controller 700 deployed to adjust hone position based on average material wear rates. Alternatively, deploying a strain gauge along with or as sensor 512, the load on the main drive 120 is detected to determine when the honing stones contact the work piece 10. As work pieces vary in exact dimensions before honing, it is useful to be able to detect when the hone stones contact the surface of the work piece. This can be accomplished with the torque strain gauge 513, or alternatively the load on the primary servo motor drive 520.

The inventive magnetic coupling 110 can be deployed to achieve the benefit of a faster machining process, in that the rotary material removal does not need to stop for the adjustment of the stone position. The magnetic coupling process is expected to provide better process control due to continuous feedback of motor torque or other sensor output indicating wear rate, and hence greater process reliability as well as final product quality. For examples, as metals that may be deployed in different work pieces have variable properties, the application of a constant pressure of the hone stone against the work piece is frequently insufficient to obtain an intended surface finish in a single process. However, monitoring the loading of the primary drive enables the application of variable pressure of the honing stones against the work piece, according to a predetermined program, to routinely obtain a targeted metal surface finish directly from the honing process.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A rotary machining tool comprising;

a) a rotating magnetic coupling having a first cylindrical bore, b) a drive axle having a first primary cylindrical axis and work tool end and a driving end opposite the work tool end, wherein the drive axle is supported by one or more rotary couplings in the rotating magnetic coupling, c) an inner axle having a second primary cylindrical axis disposed concentrically within at least a portion of the drive axle, wherein the inner axle is supported by one or more rotary couplings in the drive axle, in which the first and second primary cylindrical axis are co-incident with a geometric center of the cylindrical bore, d) a magnet coupling means having a portion attached to the outer periphery of the inner axle that is operative to co-rotate the inner axle with the external rotation of the magnetic coupling, e) a tool head coupled to the working tool end of said drive axle, said tool head having a third primary cylindrical axis and comprising, i) a plurality of abrasive members tangential spaced apart about the third cylindrical axis, each abrasive member coupled to a radial positioning means for radial position adjustment from at least partially within the tool head to beyond an outer periphery of the tool head, ii) at least one drive means for coupling torque from the inner axle to the radial positioning means.

2. The rotary machining tool of claim 1 wherein each of the abrasive members is set in a gear driven support member which is geared to advance or retract in the radial direction with respect to the third cylindrical axis, and the radial positioning means is a pinion gear drive coupled to the inner axle that urges the simultaneous drive of the geared support members when the inner and outer axle rotate at different speeds.

3. The rotary machining tool of claim 2 wherein the magnet coupling means is a plurality of magnets and an AC induction coil.

4. The rotary machining tool of claim 2 further comprising a drive means to rotate the inner axle and drive axle.

5. The rotary machining tool of claim 4 wherein the drive means for one or more of the inner axle and drive axle is selected from the group consisting of a direct drive motor, a motor coupled via one or more gears to the inner axle or drive axle and an offset drive belt coupled to the inner axle or drive axle.

6. The rotary machining tool of claim 2 further comprising one or more sensors means to determine at least one of the position and point of contact of the abrasive members with a work piece being honed by the rotary machine tool.

7. The rotary machining tool of claim 6 further comprising one or more sensors means to determine at least one of the position and point of contact of the abrasive members with a work piece being honed by the rotary machine tool.

8. The rotary machining tool of claim 7 wherein said one or more sensors means are operative to detect a current draw of a motor operative to rotate the drive axle to determine position and/or point of contact of the abrasive members.

9. The rotary machining tool of claim 2 wherein the magnet coupling means further comprises a first plurality of magnets disposed about the inner periphery of the first cylindrical bore, wherein the magnets in said plurality are arranged with opposing polarity to each adjacent magnets and the portion of the magnet coupling means attached to the outer periphery of the inner axle is a second plurality of magnets, wherein the magnetic in the second plurality are arranged with opposing polarity to each adjacent magnet in the second plurality.

10. The rotary machining tool of claim 2 further comprising a means for measuring the position of the abrasive members.

11. The rotary machining tool of claim 1 wherein the magnet coupling means further comprises a first plurality of magnets disposed about the inner periphery of the first cylindrical bore, wherein the magnets in said plurality are arranged with opposing polarity to each adjacent magnets and the portion of the magnet coupling means attached to the outer periphery of the inner axle is a second plurality of magnets, wherein the magnetic in the second plurality are arranged with opposing polarity to each adjacent magnet in the second plurality.

12. The rotary machining tool of claim 11 further comprising a means for measuring the position of the abrasive members.

13. The rotary machining tool of claim 1 wherein the magnet coupling means is a plurality of magnets and an AC induction coil.

14. The rotary machining tool of claim 1 further comprising a drive means to rotate the inner axle and drive axle.

15. The rotary machining tool of claim 14 wherein the drive means for one or more of the inner axle and drive axle is selected from the group consisting of a direct drive motor, a motor coupled via one or more gears to the inner axle or drive axle and an offset drive belt coupled to the inner axle or drive axle.

16. The rotary machining tool of claim 14 further comprising one or more sensors means to determine at least one of the position and point of contact of the abrasive members with a work piece being honed by the rotary machine tool.

17. The rotary machining tool of claim 16 wherein said one or more sensors means are operative to detect a current draw of a motor operative to rotate the drive axle to determine position and/or point of contact of the abrasive members.

18. The rotary machining tool of claim 1 further comprising one or more sensors means to determine at least one of the position and point of contact of the abrasive members with a work piece being honed by the rotary machine tool.

19. The rotary machining tool of claim 1 further comprising a means for measuring the position of the abrasive members.

20. The rotary machining tool of claim 19 wherein the means for measuring the position of the abrasive members is a rotary encoder.

21. The rotary machining tool of claim 20 wherein the rotary encoder is operative to measure the position of the radial positioning means.

* * * * *